US012152849B1

(12) United States Patent
Bray

(10) Patent No.: US 12,152,849 B1
(45) Date of Patent: Nov. 26, 2024

(54) FIREARM TRIGGER

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 18/636,009

(22) Filed: Apr. 15, 2024

(51) Int. Cl.
*F41A 19/10* (2006.01)
*F41A 17/46* (2006.01)
*F41A 19/32* (2006.01)
*F41A 19/45* (2006.01)

(52) U.S. Cl.
CPC ..... *F41A 19/10* (2013.01); *F41A 17/46* (2013.01); *F41A 19/32* (2013.01); *F41A 19/45* (2013.01)

(58) Field of Classification Search
CPC ..... F41A 19/10; F41A 19/12; F41A 19/29; F41A 19/30; F41A 19/31; F41A 19/32; F41A 19/34; F41A 19/35
See application file for complete search history.

(56) References Cited

U.S. PATENT DOCUMENTS 4,539,889 A 9/1985 Glock
5,086,578 A * 2/1992 Lishness ..... F41A 19/32 42/69.02
5,105,570 A * 4/1992 Lishness ..... F41A 19/30 267/169
5,386,659 A * 2/1995 Vaid ..... F41A 19/32 42/69.02
5,513,460 A * 5/1996 Van Niekerk ..... F41A 3/68 42/70.07
5,537,769 A 7/1996 Hargraves et al.
5,560,134 A * 10/1996 Van Niekerk ..... F41A 17/46 42/70.06
5,906,066 A * 5/1999 Felk ..... F41A 11/02 42/69.02
6,308,448 B1 10/2001 Kapusta et al.
6,665,973 B1 * 12/2003 Peev ..... F41A 19/33 42/69.01
6,718,680 B2 * 4/2004 Roca ..... F41A 17/46 89/184
6,843,013 B2 1/2005 Cutini et al.
6,907,814 B2 6/2005 Spinner et al.
(Continued)

FOREIGN PATENT DOCUMENTS

EP 3153809 A1 * 4/2017
EP 4098967 A1 12/2022
(Continued)

*Primary Examiner* — Gabriel J. Klein
(74) *Attorney, Agent, or Firm* — Kunzler Bean & Adamson

(57) ABSTRACT

Disclosed is a linear trigger mechanism for a firearm. In certain examples, the trigger mechanism includes a trigger housing configured to couple with a frame of the firearm. The trigger mechanism also includes a trigger disposed below the trigger housing and slideably coupled with the trigger housing, and a trigger bar having a first end coupled with the trigger and a second end slideably coupled with an ejector housing. The trigger mechanism also includes a sear assembly pivotally coupled with the second end of the trigger bar and configured to engage a firing pin of the firearm.

16 Claims, 6 Drawing Sheets

(56) References Cited

U.S. PATENT DOCUMENTS

| | | | | |
|---|---|---|---|---|
| 7,194,833 | B1 * | 3/2007 | Curry | F41A 19/31 42/16 |
| 7,380,362 | B2 | 6/2008 | Curry et al. | |
| 7,472,507 | B2 | 1/2009 | Curry et al. | |
| 7,617,628 | B2 | 11/2009 | Curry | |
| 7,810,268 | B1 | 10/2010 | McGarry | |
| 8,720,096 | B2 | 5/2014 | Siddle | |
| 8,925,232 | B2 | 1/2015 | da Silveria | |
| 9,383,153 | B2 | 7/2016 | Nebeker et al. | |
| 9,410,760 | B2 | 8/2016 | Siddle | |
| 9,915,485 | B2 | 3/2018 | Hudson, III et al. | |
| 10,119,777 | B2 | 11/2018 | Wolf et al. | |
| 10,126,082 | B2 | 11/2018 | Hudson, III et al. | |
| 10,209,019 | B2 | 2/2019 | Dechant | |
| 10,222,159 | B1 * | 3/2019 | Carr | F41A 17/46 |
| 10,240,880 | B1 * | 3/2019 | Viani | F41A 19/32 |
| 10,260,828 | B2 | 4/2019 | Harrigan et al. | |
| 10,663,245 | B2 | 5/2020 | Folk et al. | |
| 10,684,087 | B2 | 6/2020 | Thomele et al. | |
| 10,809,025 | B2 | 10/2020 | Harrigan et al. | |
| 11,274,895 | B2 * | 3/2022 | Niswander | F41A 19/10 |
| 11,385,009 | B2 | 7/2022 | Hudson, III et al. | |
| 11,525,645 | B2 | 12/2022 | Wolf et al. | |
| 11,815,321 | B2 * | 11/2023 | Niswander | F41A 19/10 |
| 11,828,552 | B1 | 11/2023 | Stojakovic | |
| 11,841,200 | B2 | 12/2023 | Velasquez | |
| 2006/0236581 | A1 * | 10/2006 | Viani | F41A 19/30 42/69.01 |
| 2006/0248772 | A1 | 11/2006 | Curry | |
| 2020/0386502 | A1 * | 12/2020 | Niswander | F41A 19/10 |
| 2021/0222980 | A1 * | 7/2021 | O'Clair | F41A 19/12 |
| 2022/0325971 | A1 * | 10/2022 | Bray | F41A 19/10 |
| 2022/0397359 | A1 * | 12/2022 | Velasquez | F41A 19/31 |
| 2023/0160650 | A1 * | 5/2023 | Douvier | F41A 11/02 42/75.01 |
| 2023/0243612 | A1 * | 8/2023 | McNamee | F41A 17/46 42/69.02 |
| 2023/0392886 | A1 * | 12/2023 | Rainaud | F41A 17/34 |
| 2024/0011729 | A1 * | 1/2024 | Dechant | F41A 19/31 |

FOREIGN PATENT DOCUMENTS

| | | | |
|---|---|---|---|
| SK | 500272015 | A3 | 12/2016 |
| WO | 97/03334 | A1 | 1/1997 |
| WO | 2006000851 | A2 | 1/2006 |

* cited by examiner

FIREARM TRIGGER

FIELD

This disclosure relates generally to firearms, and more particularly to linear trigger mechanisms for firearms.

BACKGROUND

Firearms typically have a trigger mechanism that is used to discharge the firearm. Commonly, trigger mechanisms have a spring-loaded hammer that strikes a firing pin that in turn strikes an ammunition cartridge positioned in a chamber of the firearm. Pulling a trigger of the trigger mechanism initiates this sequence. A rough or uneven trigger pull can affect the accuracy of the firearm.

SUMMARY

Disclosed is a linear trigger mechanism for a firearm. In certain examples, the trigger mechanism includes a trigger housing configured to couple with a frame of the firearm. The trigger mechanism also includes a trigger disposed below the trigger housing and slideably coupled with the trigger housing, and a trigger bar having a first end coupled with the trigger and a second end slideably coupled with an ejector housing. The trigger mechanism also includes a sear assembly pivotally coupled with the second end of the trigger bar and configured to engage a firing pin of the firearm.

The trigger mechanism also includes, in certain examples, a trigger safety slideably coupled with the trigger and moveable between a first position and a second position with reference to the trigger. The trigger mechanism may also include a blocking lever pivotally coupled with the trigger and moveable between a blocking position that prevents linear movement of the trigger and an allow position that allows linear movement of the trigger.

In certain examples, the trigger safety is configured to actuate the blocking lever and move the blocking lever from the blocking position to the allow position when the trigger safety is moved to the second position. The trigger mechanism also includes a compression spring configured to bias the blocking lever to blocking position.

The trigger mechanism also includes, in certain examples, a spring-loaded ball detent disposed between the sear assembly and the ejector housing, where the spring-loaded ball detent is configured to bias the sear assembly to a locking position that prevents the firing pin from moving with reference to the frame. In certain examples, the trigger mechanism also includes a connector having a first end that is coupled with the ejector housing and a second end that is configured to actuate the sear assembly in response to the trigger moving rearward with reference to the frame. The trigger housing may include a slotted channel configured to define a path of travel of the trigger. In certain examples, the trigger is formed with a slotted tab configured to engage the slotted channel. The path of travel is linear and substantially parallel with a bore axis of the firearm.

Also disclosed is a firearm that implements the trigger mechanism. The firearm includes a frame, a slide, a barrel, the trigger mechanism, and other components. Also disclosed is a method for providing the firearm. In certain examples, the method includes providing a trigger housing configured to couple with a frame of the firearm, and providing a trigger disposed below the trigger housing and slideably coupled with the trigger housing. In certain examples, the method includes providing a trigger bar having a first end coupled with the trigger and a second end slideably coupled with an ejector housing, and providing a sear assembly pivotally coupled with the second end of the trigger bar and configured to engage a firing pin of the firearm.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the disclosure will be described and explained with additional specificity and detail through the use of the accompanying drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
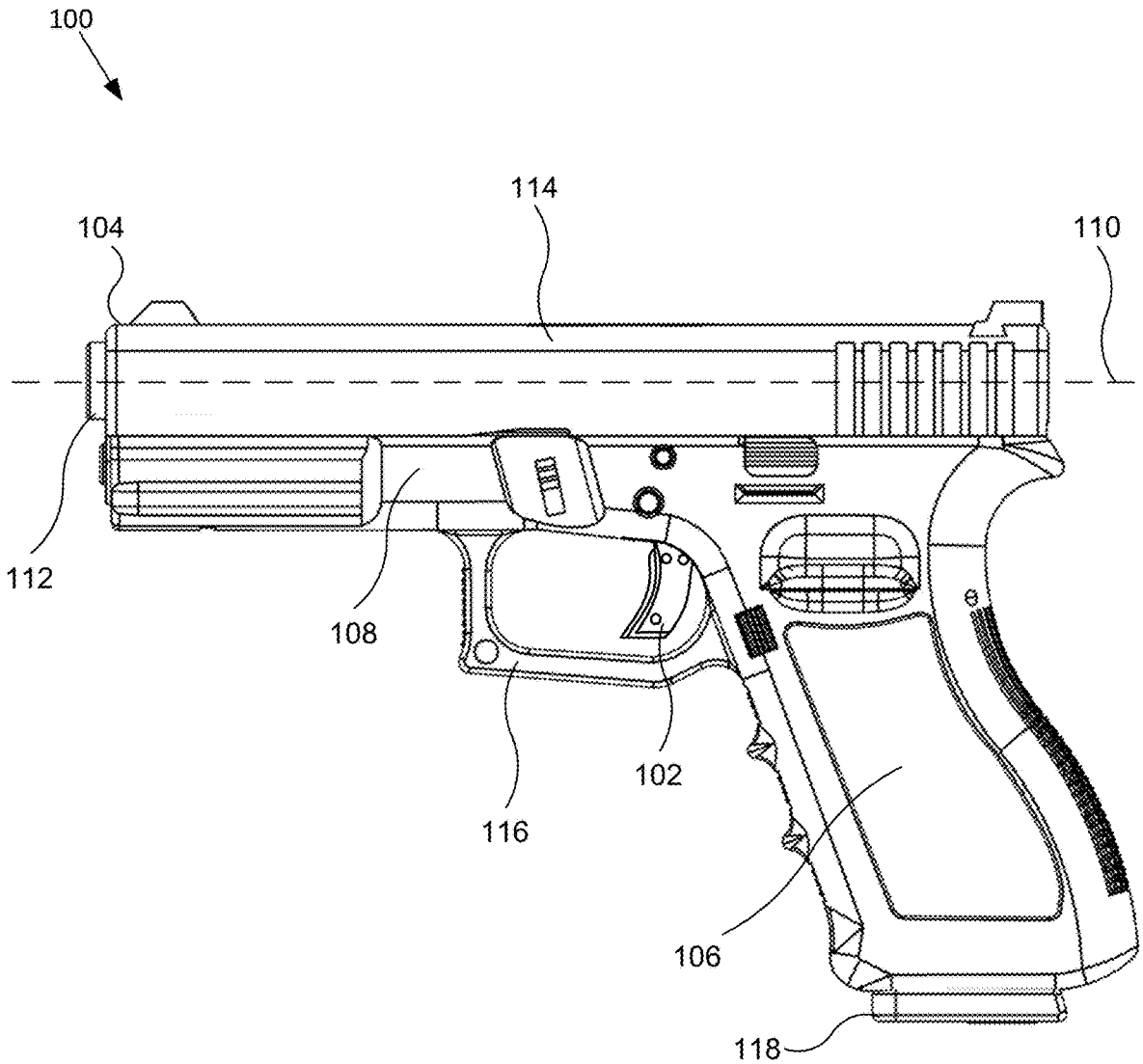
FIG. 1 is a side view diagram illustrating one example of a firearm including an improved trigger mechanism in accordance with examples of the subject disclosure.

FIG. 1 is a side view diagram illustrating one example of a firearm 100 including an improved trigger mechanism 102 in accordance with examples of the subject disclosure. The trigger mechanism 102, in the depicted example, may be used with the GLOCK® family of firearms or clones. As used herein, the terms "forward" and "front" refer to ends of mechanisms that are nearest the muzzle end 104 of the firearm 100. Similarly, "rear," or "rearward," corresponds to ends of mechanisms that are furthest from the muzzle end 104 of the firearm (i.e., towards grip 106). Terms such as "top" and "bottom" may also be used and refer to component positions as if the firearm were held in a traditional orientation, for example with the slide 114 located on "top" of or "above" the frame 108. However, it is contemplated that the features of the current disclosure are equally applicable to other types of firearms.

As will be discussed in greater detail below, the present disclosure provides a linearly moving trigger slide mounted within the trigger mechanism 102 to provide predictability and repeatability of trigger pulls. The trigger slide beneficially moves linearly in relation to a frame 108 of the firearm 100. In certain examples, the trigger slide moves substantially parallel with a bore axis 110 that is defined by a barrel 112 of the firearm 100.

The firearm 100 generally comprises a slide 114 that houses and carries the barrel 112. The slide 114 moves forward and backward on the frame 108 when the firearm 100 is fired. The frame 108 is formed with the grip 106 portion, and a trigger guard 116. The grip 106 is hollow and forms a magazine well for a magazine 118.

Figure 2:
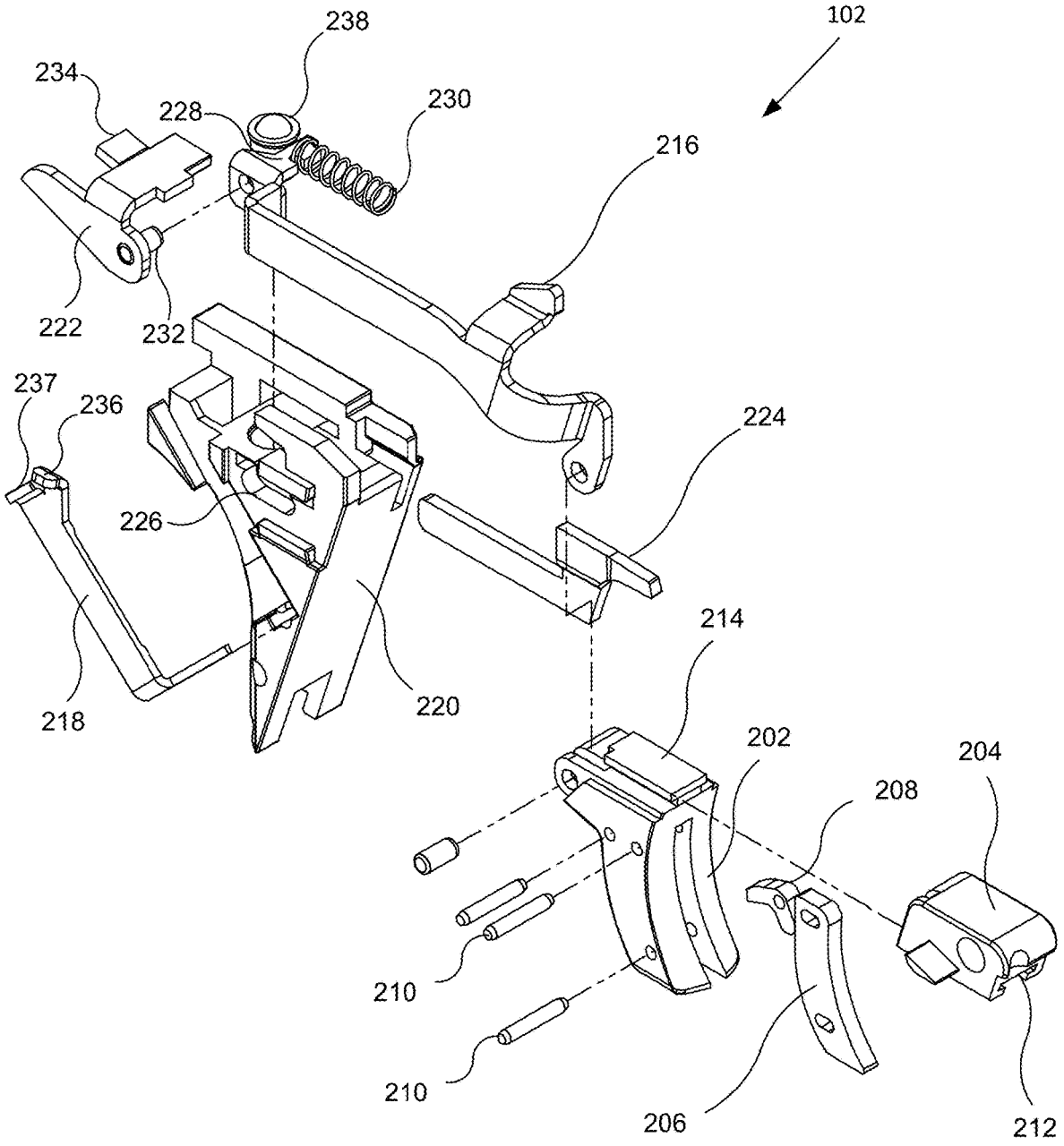
FIG. 2 is an exploded view diagram illustrating one example of the trigger mechanism, in accordance with examples of the subject disclosure.

FIG. 2 is an exploded view diagram illustrating one example of the trigger mechanism 102, in accordance with examples of the subject disclosure. The trigger mechanism 102, beneficially, provides a trigger 202 that slides linearly with respect to the frame 108. Conversely, all current GLOCK® triggers rotate about a pivot point.

In certain examples, the trigger mechanism 102 includes the trigger 202, a trigger housing 204, a trigger safety 206, and a blocking lever 208. The trigger 202 has a generally concave surface configured for engaging a finger of an operator. A vertically oriented opening in the concave surface is configured to receive the trigger safety 206. The trigger safety 206, as depicted, is an elongated member having a concave finger-engaging surface that is similar to the concave surface of the trigger 202. The trigger safety 206 is configured to slide forward and backward with reference to the trigger 202. Elongated, horizontally oriented slots are formed in the trigger safety 206 and are configured to receive a pin 210. The elongated slot has a width greater than a diameter of the pin 210 and defines a path through which the trigger safety 206 moves. In other words, the trigger safety 206 moves from a default position where the trigger 202 is not allowed to release a firing pin, to an activated position that engages the blocking lever 208 and allows the trigger 202 to release the firing pin. The blocking lever 208 will be described in greater detail below with respect to FIG. XXX.

The trigger housing 204, in certain examples, is positioned forward of the trigger 202 in the frame 108, and includes a trigger housing slot 212 for defining a linear pathway for the trigger 202. In some examples, the trigger housing slot 212 is an inverted T-slot track that is configured to receive a T-shaped tab 214 of the trigger 202. In certain examples, the tab 214 is disposed on top of the trigger 202. Although T-shaped slots and tabs are depicted, any shape track and tab system is contemplated. Beneficially, the trigger housing 204 and the trigger housing slot 212 define a pathway that linear and substantially parallel with the axis 110. A linearly moving trigger 202, instead of a trigger that pivots around a pivot point, produces a better trigger pull that is repeatable because a compression spring may be used to bias the movement of the trigger 202.

In certain examples, the trigger mechanism 102 also includes a trigger bar 216, a connector 218, an ejector housing 220, a sear assembly 222, and an ejector 224. The trigger bar 216 slideably couples the trigger 202 with the ejector housing 220. A slot 226 formed in a side of the ejector housing 220 defines a pathway for a laterally extending protrusion 228 of the trigger bar 216. Disposed within the ejector housing 220 is a torsion spring 230 that biases the trigger bar 216, and consequently the trigger 202, toward a first position. In other words, the torsion spring 230 urges the trigger 202 to a first position that does not allow the firearm 100 to fire. When an operator squeezes the trigger 202, if the force applied to the trigger 202, which is transferred through the trigger bar 216, is sufficient to overcome the torsion spring 230, then the firing pin is released, as will be described in greater detail below.

The sear assembly 222, in certain examples, includes a pin 232 that extends through an opening in an end of the trigger bar 216 and into the slot 226 in the ejector housing 220. The sear assembly 222 includes an upwardly extending catch 234 that engages the firing pin each time the slide 114 recoils after firing a round. An outwardly extending tab 237 of the connector 218 engages a protrusion of the sear assembly 222. As the trigger 202 moves linearly rearward, the trigger bar 216 and the sear assembly 222 likewise move and push downward on the connector 218. The tab 237 pulls the sear assembly 222 downward and causes it to pivot about the pin 232. If the rotational movement is sufficient, the catch 234 releases the firing pin and the firearm 100 fires. In certain examples, a spring-loaded ball detent 238 biases the sear assembly 222 into a position that maintains the firing pin a "ready to fire" position. The finger 236 engages a portion of the underside of the slide, which allows the sear assembly 222 to be released and moved upward, after firing by the spring-loaded ball detent 238, into a position to engage the firing pin. The spring-loaded ball detent 238 is disposed partially, in certain examples, within the ejector housing 220. The spring-loaded ball detent 238 is disposed between the ejector housing 220 and the sear assembly 222.

Figure 3:
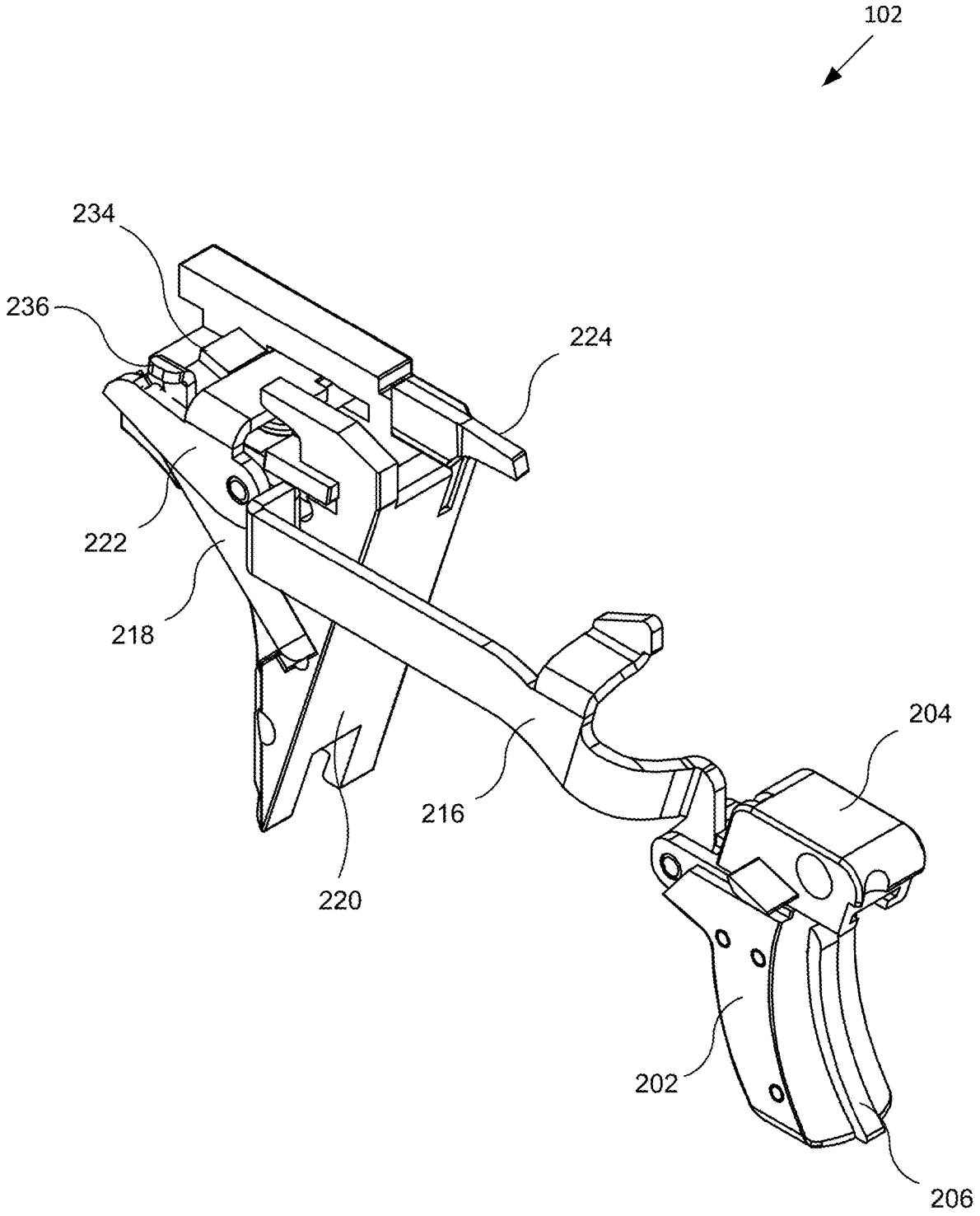
FIG. 3 is a perspective view diagram of the trigger mechanism, in accordance with examples of the subject disclosure.

FIG. 3 is a perspective view diagram of the trigger mechanism 102, in accordance with examples of the subject disclosure. The depicted example illustrates the trigger mechanism 102 in an assembled state. As described above, the trigger 202 moves linearly along a longitudinal axis (i.e., from front to rear of the firearm 100, or vice versa) when actuated by an operator. Linear movement of the trigger 202 is transferred by the trigger bar 216 to the sear assembly 222 and the connector 218. As the connector 218 pivots downward, the finger 236 pulls the sear assembly 222 downward and the catch 234 disengages from the firing pin.

Figure 4A:
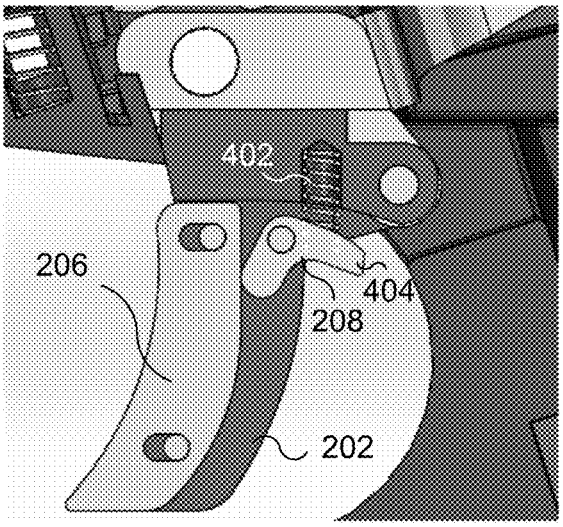
FIG. 4A is a side view diagram illustrating the trigger and the blocking lever, in accordance with examples of the subject disclosure.
Figure 4B:
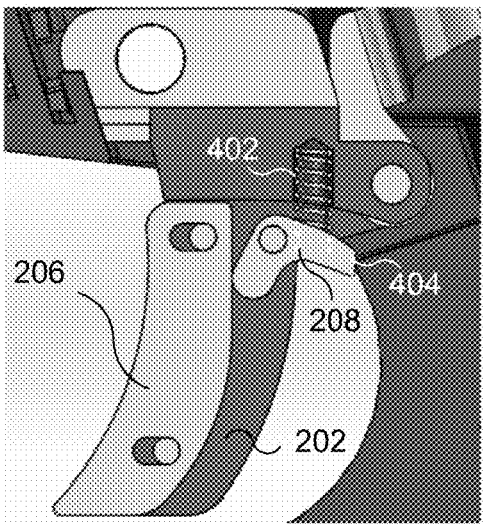
FIG. 4B is another side view diagram illustrating the trigger and the blocking lever, in accordance with examples of the subject disclosure.
Figure 4C:
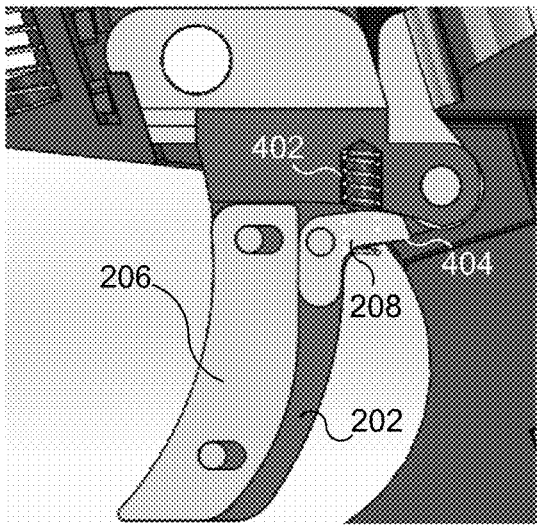
FIG. 4C is another side view diagram illustrating the trigger and the blocking lever, in accordance with examples of the subject disclosure.

FIGS. 4A, 4B, and 4C are side view diagrams illustrating the trigger 202 and the blocking lever 208, in accordance with examples of the subject disclosure. FIG. 4A depicts the trigger 202, the trigger safety 206, and the blocking lever 208 in a first position that is not actuated or pulled by an operator. In the first position, the trigger safety 206 is biased forward by a spring 402 that pushes downward on one leg of the blocking lever 208. The leg is rotated and positioned by the spring 402 in a slightly downward orientation that prevents the trigger 202 from moving linearly towards the rear of the firearm 100.

FIG. 4B depicts a situation where the trigger safety 206 is not depressed relative to the trigger 202. In certain examples, when the trigger safety 206 is not depressed and the trigger 202 is moved, the leg 404 contacts the frame 108 and prevents further rearward movement of the trigger 202.

FIG. 4C depicts a situation where the trigger safety 206 is depressed and moved rearwardly before the trigger 202 is moved. In certain examples, the trigger safety 206 pushes on the blocking lever 208 and rotates the leg 404 upward, which compresses the spring 402, and allows the trigger 202 to move rearward to a position that disengages the catch 234 and allows the firearm 100 to fire.

Figure 5B:
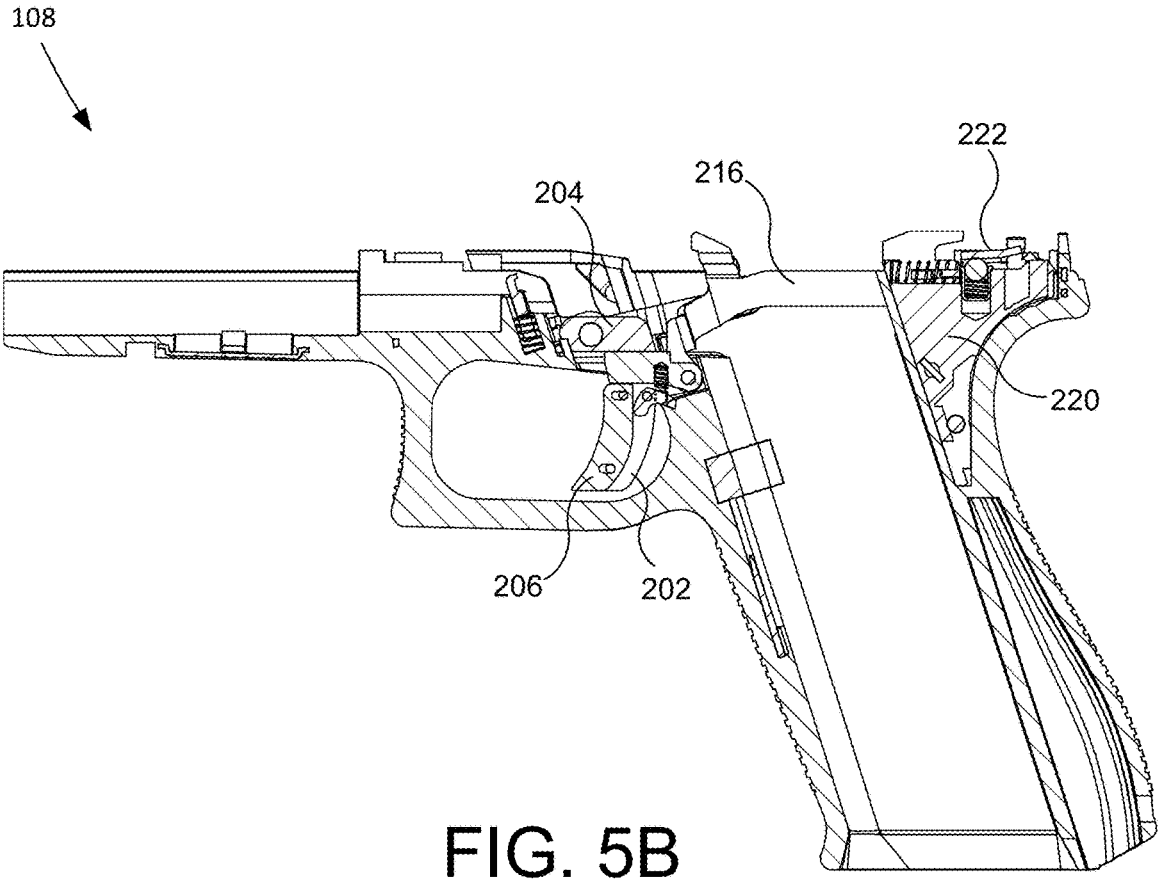
FIG. 5B is a cross-sectional diagram of the frame, in accordance with examples of the subject disclosure.
Figure 5A:
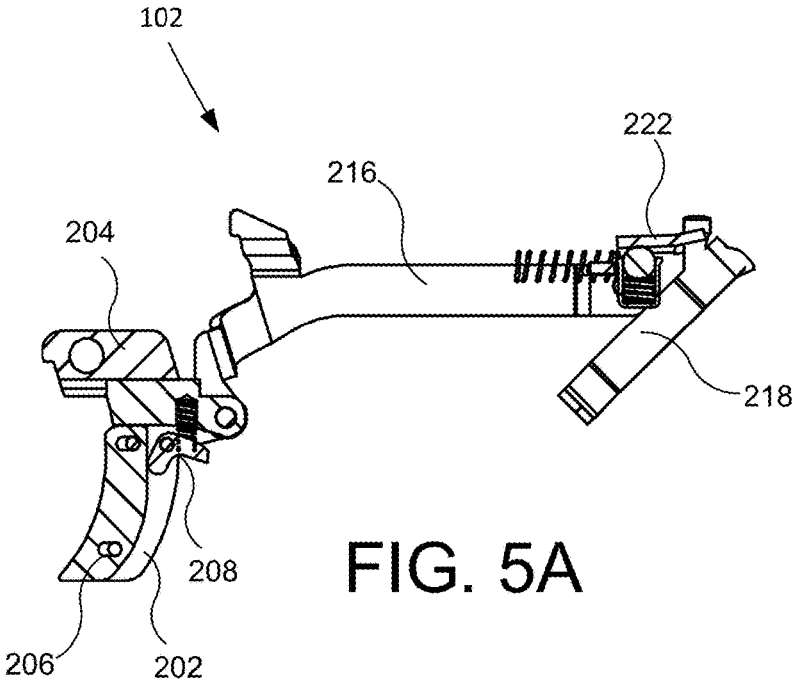
FIG. 5A is cross-sectional diagram of the trigger mechanism, in accordance with examples of the subject disclosure.

FIGS. 5A and 5B are cross-sectional diagrams of the trigger mechanism 102 and the frame 108, respectively, in accordance with examples of the subject disclosure. Depicted here is the left side of the frame 108 with the trigger mechanism 102 installed. As described above, the trigger safety 206 is disposed in a slot of the trigger 202. The trigger safety 206 is movable from a first position to a second position with reference to the trigger 202. The trigger 202 is movable from a first position to a second position with reference to the frame 108. If the trigger 202 moves before the trigger safety 206 is moved to the second position, the blocking lever 208 prevents the trigger 202 from moving sufficiently to fire the firearm 100. In certain examples, the trigger 202 is coupled to an end of the trigger bar 216. Also depicted here is the connector 218, the ejector housing 220, the sear assembly 222, the ball detent 238.

Figure 6:
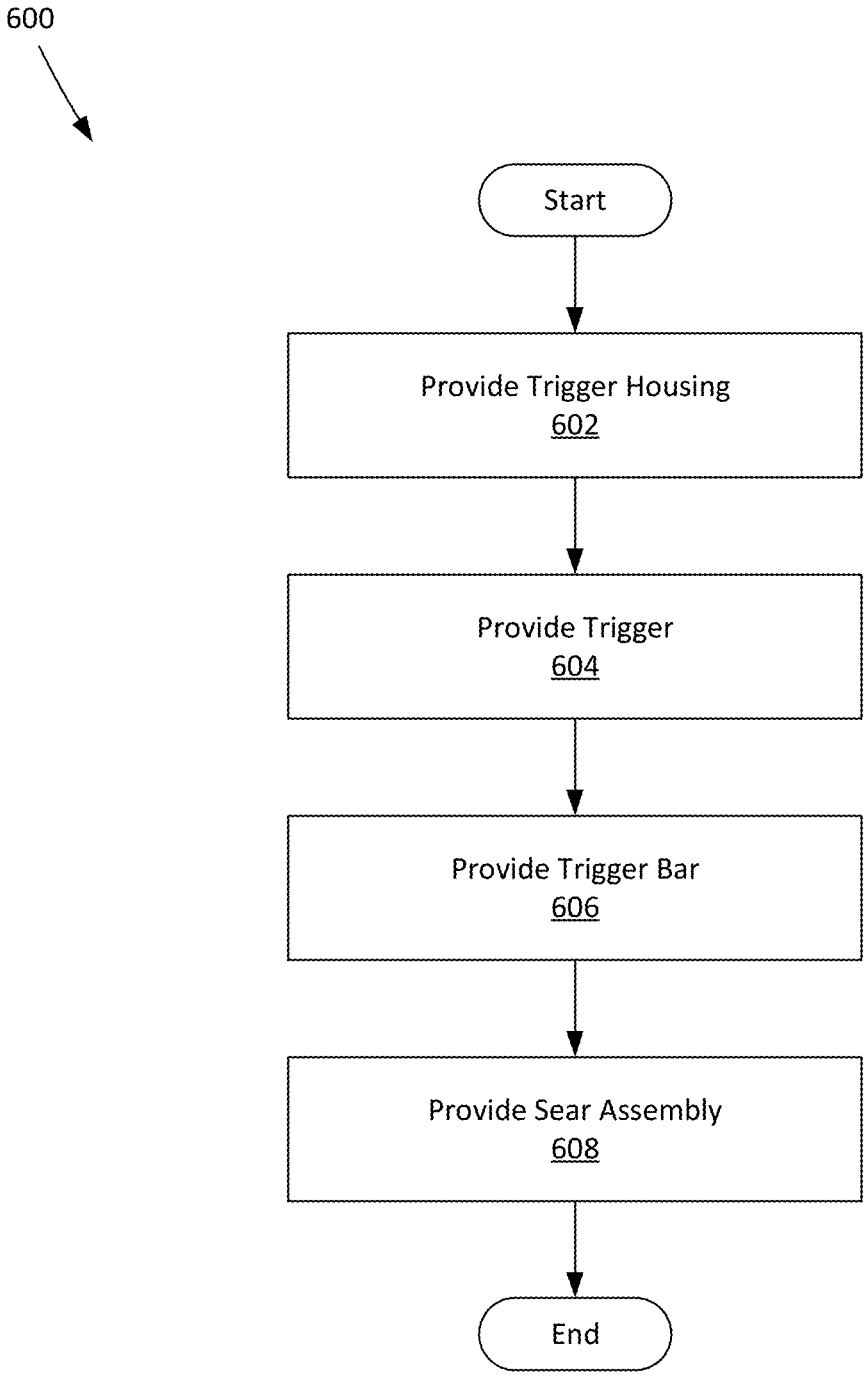
FIG. 6 is a schematic flowchart diagram illustrating one example of a method for providing a trigger mechanism in accordance with examples of the subject disclosure.

FIG. 6 is a schematic flowchart diagram illustrating one example of a method 600 for providing a trigger mechanism 102 in accordance with examples of the subject disclosure. In certain examples, the method 600 starts and, at block 602, a trigger housing is provided that is configured to couple with a frame of the firearm. The trigger housing is provided as described above with reference to FIGS. 1-5. The method 600 continues at block 604, and a trigger is provided. In certain examples, the trigger is slideable linearly with respect to the frame.

At block 606, the method 600 continues and a trigger bar is provided. The trigger bar, in certain examples, is provided as described above, with a first end coupled with the trigger, and a second end coupled with the ejector housing. At block 608, the method 600 continues and a sear assembly is provided. The sear assembly, in certain examples, is pivotally coupled with the second end of the trigger bar, as described above.

In the above description, certain terms may be used such as "up," "down," "upper," "lower," "horizontal," "vertical," "left," "right," "over," "under" and the like. These terms are used, where applicable, to provide some clarity of description when dealing with relative relationships. These terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent to another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A trigger mechanism for a firearm, comprising:

a trigger housing configured to couple with a frame of the firearm;

a trigger disposed below the trigger housing and slideably coupled with the trigger housing;

a trigger safety slideably coupled with the trigger and translatable between a first position and a second position with reference to the trigger;

a blocking lever pivotally coupled with the trigger and moveable between a blocking position that engages the frame and prevents linear movement of the trigger and an allow position that allows linear movement of the trigger;

a trigger bar having a first end coupled with the trigger and a second end slideably coupled with an ejector housing; and a sear assembly pivotally coupled with the second end of the trigger bar and configured to engage a firing pin of the firearm.

2. The trigger mechanism of claim 1, where the trigger safety is configured to actuate the blocking lever and move the blocking lever from the blocking position to the allow position when the trigger safety is moved to the second position.

3. The trigger mechanism of claim 1, further comprising a compression spring configured to bias the blocking lever to blocking position.

4. The trigger mechanism of claim 1, further comprising a spring-loaded ball detent disposed between the sear assembly and the ejector housing, where the spring-loaded ball detent is configured to bias the sear assembly to a locking position that prevents the firing pin from moving with reference to the frame.

5. The trigger mechanism of claim 1, further comprising a connector having a first end that is coupled with the ejector housing and a second end that is configured to actuate the sear assembly in response to the trigger moving rearward with reference to the frame.

6. The trigger mechanism of claim 1, where the trigger housing comprises a slotted channel configured to define a path of travel of the trigger.

7. The trigger mechanism of claim 6, where the trigger comprises a slotted tab configured to engage the slotted channel.

8. The trigger mechanism of claim 7, where the path of travel is linear and substantially parallel with a bore axis of the firearm.

9. A firearm having a linearly moveable trigger with respect to the firearm, the firearm comprising:

a frame;

a barrel disposed in a slide, where the slide is slideably coupled with the frame;

a trigger housing configured to couple with the frame;

a trigger disposed below the trigger housing and slideably coupled with the trigger housing;

a trigger safety slideably coupled with the trigger and translatable between a first position and a second position with reference to the trigger;

a blocking lever pivotally coupled with the trigger and moveable between a blocking position that engages the frame and prevents linear movement of the trigger and an allow position that allows linear movement of the trigger;

a trigger bar having a first end coupled with the trigger and a second end slideably coupled with an ejector housing; and a sear assembly pivotally coupled with the second end of the trigger bar and configured to engage a firing pin.

10. The firearm of claim 9, where the trigger safety is configured to actuate the blocking lever and move the blocking lever from the blocking position to the allow position when the trigger safety is moved to the second position.

11. The firearm of claim 9, further comprising a compression spring configured to bias the blocking lever to blocking position.

12. The firearm of claim 9, further comprising a spring-loaded ball detent disposed between the sear assembly and the ejector housing, where the spring-loaded ball detent is configured to bias the sear assembly to a locking position that prevents the firing pin from moving with reference to the frame.

13. The firearm of claim 9, further comprising a connector having a first end that is coupled with the ejector housing and a second end that is configured to actuate the sear assembly in response to the trigger moving rearward with reference to the frame.

14. The firearm of claim 9, where the trigger housing comprises a slotted channel configured to define a path of travel of the trigger.

15. The firearm of claim 14, where the trigger comprises a slotted tab configured to engage the slotted channel.

16. A method comprising:

providing a trigger housing configured to couple with a frame of a firearm;

providing a trigger disposed below the trigger housing and slideably coupled with the trigger housing;

providing a trigger safety slideably coupled with the trigger and translatable between a first position and a second position with reference to the trigger;

providing a blocking lever pivotally coupled with the trigger and moveable between a blocking position that engages the frame and prevents linear movement of the trigger and an allow position that allows linear movement of the trigger;

providing a trigger bar having a first end coupled with the trigger and a second end slideably coupled with an ejector housing; and providing a sear assembly pivotally coupled with the second end of the trigger bar and configured to engage a firing pin of the firearm.

* * * * *